US008421584B2

(12) United States Patent
Tsai et al.

(10) Patent No.: US 8,421,584 B2
(45) Date of Patent: Apr. 16, 2013

(54) OVER-CURRENT PROTECTION DEVICE AND METHOD FOR MANUFACTURING THE SAME

(75) Inventors: Tong Cheng Tsai, Tainan (TW); Yi An Sha, New Taipei (TW); David Shau Chew Wang, Taipei (TW); Fu Hua Chu, Taipei (TW)

(73) Assignee: Polytronics Technology Corp., Hsinchu (TW)

( * ) Notice: Subject to any disclaimer, the term of this patent is extended or adjusted under 35 U.S.C. 154(b) by 0 days.

(21) Appl. No.: 13/351,700

(22) Filed: Jan. 17, 2012

(65) Prior Publication Data

US 2012/0182118 A1 Jul. 19, 2012

(30) Foreign Application Priority Data

Jan. 17, 2011 (TW) ..... 100101583 A

(51) Int. Cl.
*H01C 7/10* (2006.01)

(52) U.S. Cl.
USPC ..... 338/22 R; 338/20; 338/328; 29/612; 29/610.1

(58) Field of Classification Search ..... 338/22 R, 338/20, 328; 219/553; 252/511, 513, 518; 29/612, 610.1
See application file for complete search history.

(56) References Cited

U.S. PATENT DOCUMENTS

| | | | | |
|---|---|---|---|---|
| 4,859,836 | A | 8/1989 | Lunk et al. | |
| 5,317,061 | A | 5/1994 | Chu et al. | |
| 5,451,919 | A | 9/1995 | Chu et al. | |
| 6,377,467 | B1 | 4/2002 | Chu et al. | |
| 6,987,440 | B2 * | 1/2006 | Becker et al. | 338/22 R |
| 7,701,322 | B2 * | 4/2010 | Wang et al. | 338/22 R |

* cited by examiner

*Primary Examiner* — Kyung Lee
(74) *Attorney, Agent, or Firm* — Stites & Harbison LLC; Juan Carlos A. Marquez, Esq.

(57) ABSTRACT

An over-current protection device includes a conductive composite having a first crystalline fluorinated polymer, a plurality of particulates, a conductive filler, and a non-conductive filler, wherein the plurality of particulates include a second crystalline fluorinated polymer. The first crystalline fluorinated polymer has a crystalline melting temperature of between 150 and 190 degrees Celsius. The plurality of particulates including the second crystalline fluorinated polymer are disposed in the conductive composite, having a crystalline melting temperature of between 320 and 390 degrees Celsius and having a particulate diameter of from 1 to 50 micrometers. The conductive filler and the non-conductive filler are dispersed in the conductive composite.

21 Claims, 2 Drawing Sheets

OVER-CURRENT PROTECTION DEVICE AND METHOD FOR MANUFACTURING THE SAME

BACKGROUND OF THE INVENTION

1. Field of the Invention

The present invention relates to an over-current protection device and a method for manufacturing the same.

2. Description of the Related Art

When switching temperature, conductive composite with a positive temperature coefficient (PTC) will be converted from a low resistance state to a high resistance state. When an over-current protection device made of such conductive composite connects in series with an external load on the electric circuit, under normal operating condition, the over-current protection device demonstrates low resistance. However, when high current passes through the over-current protection device or when the device is heated to high temperature, the resistance immediately rises. The change in resistance effectively limits the current passing through the over-current protection device, and therefore protects the electronic devices in the electric circuit.

A general PTC conductive composite comprises one or more polyolefin polymers and conductive filler, among which the polymer can be polyethylene, polypropylene, and/or polymethylmethacrylate; the conductive filler can typically be carbon black, metal particulates (e.g., nickel, gold, silver, etc.), or oxygen-free ceramic powder (e.g., titanium carbide, tungsten carbide, or their eutectic materials). However, polyolefines has a crystalline melting temperature of less than 130 degrees Celsius, causing devices made of polyolefines to behave abnormally when temperature changes drastically.

U.S. Pat. Nos. 4,859,836 and 5,317,061 disclose a conductive composite, which includes tetrafluoroethylene-hexafluoropropylene copolymer (FEP), tetrafluoroethylene and perfluoro (propylvinyl ether) copolymer (PFA), irradiated polytetrafluoroethylene (PTFE), and carbon black. The high crystalline melting temperature (270 to 340 degrees Celsius) of FEP and PFA makes the aforementioned conductive composite difficult to manufacture. In addition, when processed at high temperature, the preceding conductive materials are inclined to pyrolyse and produce corrosive gases. Moreover, the high crystalline melting temperatures of FEP, PFA, and PTFE lead to excessive high temperature when the device is activated, and further melts the tin solder at the welded point. Consequently, damage at the joint or distortion of the plastic fixture may occur.

U.S. Pat. No. 5,451,919 discloses another conductive composite, which comprises polyvinylidene fluoride (PVDF), ethylene/tetrafluoroethylene (ETFE), and carbon black. In some embodiments, photo-crosslinking agent-triallylisocyanurate (TAIC) and calcium carbonate ($CaCO_3$) are added to conductive composite. Under irradiation, TAIC facilitates the polymer cross-link reaction and improves the stability of product size and operating temperature. Based on experimental results, adding ETFE enhances the stability of over-current protection devices. However, employing ETFE material in conductive composite manufacturing requires high processing temperatures (at least 260 degrees Celsius). This high temperature process pyrolyses a small quantity of PVDF, and generates corrosive gases such as hydrofluoric acid. Although adding alkaline fillers such as $CaCO_3$ promotes neutralization, this method increases manufacturing cost because processing equipment used to manufacture the aforementioned conductive composite requires special alloy material.

In addition to the above-mentioned disadvantages, extra care must be taken concerning the problems generated from the installation of over-current protection devices in harsh environments. For instance, an over-current protection device installed under a car engine hood not only will be affected by high temperature caused by engine operation, but also needs to withstand drastic climate changes such as cold, heat, dryness and humidity that occur outside of the car. Conventional over-current protection devices could operate only under well-controlled environments. Therefore, an over-current protection device that can function stably at high temperature and in drastically changing climates is under expectation.

SUMMARY OF THE INVENTION

One aspect of the present invention provides an over-current protection device comprising a conductive composite that exhibits small differences in resistance before and after the device is tripped.

Another aspect of the present invention provides an over-current protection device comprising a conductive composite that requires low processing temperature, which minimizes the environmental hazard generated from the manufacturing process.

Still another aspect of the present invention provides an over-current protection device having a higher operating temperature, better resistance recovery, and superior humidity and temperature resistance than prior arts.

According to the aforementioned aspects, an embodiment of the present invention provides an over-current protection device, which includes a conductive composite having a first crystalline fluorinated polymer, a plurality of particulates, a conductive filler, and a non-conductive filler, wherein the plurality of particulates include a second crystalline fluorinated polymer. The first crystalline fluorinated polymer has a first crystalline melting temperature of between 150 and 190 degrees Celsius. The second crystalline fluorinated polymer are disposed in the conductive composite, having a second crystalline melting temperature of between 320 and 390 degrees Celsius and having a particulate diameter of from 1 to 50 micrometers. The conductive filler and the non-conductive filler are dispersed in the conductive composite.

One embodiment of the present invention provides a method for manufacturing an over-current protection device, including the steps of: at a predetermined temperature, mixing a first powder of a first crystalline fluorinated polymer, a second powder of a second crystalline fluorinated polymer, a conductive filler, and a non-conductive filler to obtain a conductive composite. The first powder has a first crystalline melting temperature of between 150 and 190 degrees Celsius, and the second power has a second crystalline melting temperature of between 320 and 390 degrees Celsius. The predetermined temperature is between the first crystalline melting temperature and the second crystalline melting temperature. Finally, the conductive composite are press-fitted at the predetermined temperature to form a conductive composite.

The foregoing has rather broadly outlined the features and technical benefits of the disclosure so that the detailed description of the invention that is to follow may be better understood. Additional features and benefits of the invention will be described hereinafter, and form the subject of the claims of the invention. It should be appreciated by those skilled in the art that the conception and specific embodiment disclosed may be readily utilized as a basis for modifying or designing other structures or processes that carry out the same purposes as the disclosure. It should also be realized by those skilled in the art that such equivalent constructions do not depart from the spirit and scope of the invention as set forth in the appended claims.

BRIEF DESCRIPTION OF THE DRAWINGS

The invention will be described according to the appended drawings in which.

DETAILED DESCRIPTION OF THE INVENTION

Figure 1:
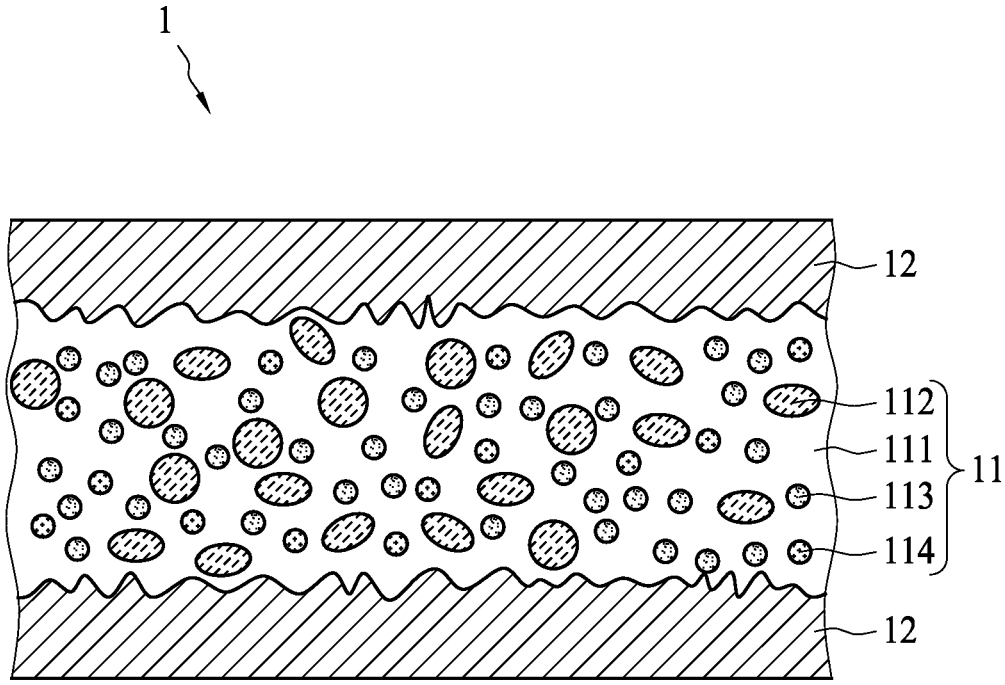
FIG. 1 illustrates a conductive composite according to one embodiment of the present invention.

FIG. 1 illustrates a conductive composite 11 with PTC characteristic according to one embodiment of the present invention. The conductive composite 11 comprises a first crystalline fluorinated polymer 111, a plurality of particulates, a conductive filler 113, and a non-conductive filler 114, wherein the plurality of particulates includes a second crystalline fluorinated polymer 112. The first crystalline fluorinated polymer 111 has a low crystalline melting temperature, and the second crystalline fluorinated polymer 112 is dispersed in the conductive composite 11 in a particulate manner. As a result, the conductive composite 11 can be processed at lower processing temperature, thereby preventing the generation of corrosive gases that causes environmental hazard.

The crystalline melting temperature of the first crystalline fluorinated polymer 111 is lower than 200 degrees Celsius, and the crystalline melting temperature of the second crystalline fluorinated polymer 112 is higher than 300 degrees Celsius. The powder of the first crystalline fluorinated polymer 111, the powder of the second crystalline fluorinated polymer 112, the conductive filler 113, and the non-conductive filler 114 are mixed at a processing temperature to obtain a conductive mixture. The processing temperature is between the crystalline melting temperature of the first crystalline fluorinated polymer 111 and the crystalline melting temperature of the second crystalline fluorinated polymer 112. The volume ratio of the first crystalline fluorinated polymer 111 to the conductive composite 11 can range from 30% to 65%, while the volume ratio of the second crystalline fluorinated polymer 112 to the conductive composite 11 can range from 1% to 15%. Because the crystalline melting temperature of the first crystalline fluorinated polymer 111 is lower than the specific processing temperature and the crystalline melting temperature of the second crystalline fluorinated polymer 112 is higher than the specific processing temperature, the second crystalline fluorinated polymer 112 is embedded in the first crystalline fluorinated polymer 111/conductive composite 11 in a particulate manner.

The first crystalline fluorinated polymer 111 comprises two different fluorinated polymers, each with a different Melt Flow Rate (MFR). The response time of the over-current protection device can be modified by changing the mixing ratio of said two different fluorinated polymers.

According to one embodiment of the present invention, the first crystalline fluorinated polymer 111 is polyvinylidene fluoride (PVDF), which has a crystalline melting temperature of between 150 and 190 degrees Celsius. A more preferable range is between 170 and 175 degree Celsius. Employing PVDF can effectively increase the activation temperature of the conductive composite 11. The volume ratio of the PVDF to the conductive composite 11 is between 30% and 65%, preferably between 45% and 63%. The first crystalline fluorinated polymer 111 further comprises two different PVDFs, each with a different MFR. According to one embodiment, one of the PVDFs has an MFR range from 0.6 to 18 g/10 min, while the other PVDF has an MFR range from 7 to 35 g/10 min.

According to one embodiment of the present invention, the second crystalline fluorinated polymer 112 comprises a plurality of particulates including polytetrafluoroethylene (PTFE), which has a crystalline melting temperature of between 320 and 390 degrees Celsius, preferably between 321 and 335 degrees Celsius. The PTFE particulates have a particulate diameter ranging from 1 to 50 micrometers. A more preferable range is between 3 and 25 micrometers. The volume ratio of the PTFE particulates to the conductive composite 11 ranges from 1% to 15%. The PTFE particulates are prepared by grinding or smashing PTFE materials, emulsion polymerization, or suspension polymerization. PTFE particulates can be used during low temperature manufacturing processes, and PTFE can be easily dispersed in material systems while mixing. Moreover, adding PTFE to the conductive composite 11 assists the crystallization of other fluorinated polymers, and prevents contract deformation of the conductive composite 11. In addition, due to the substantially high melting temperature of crystalline PTFE (more than 300 degrees Celsius), PTFE is not inclined to melt when the conductive composite is processed at a lower processing temperature (e.g., lower than 250 degrees Celsius). Under such circumstances, PTFE can be viewed as an organic molecule filler in the conductive composite 11. When fabricating conductive composite 11, PTFE is not prone to melting and mixing with other polymers (e.g., PVDF), but rather disperses homogeneously in a particulate manner. Furthermore, because PTFE has a molecular structure similar to that of PVDF, after the tripping takes place, PTFE can act as a crystallization nucleus for the recrystallization of the melted PVDF, and induces a relaxation of the stresses in the stacked PVDF molecular chains, thereby allowing the conductive composite 11 to return to its original form and dimension. Hence, PTFE powder not only effectively decreases the discrepancy in size and volume after multiple actions of the protection device, but also substantially decreases the difference in resistance before and after the protection device is tripped. In addition, the molecular weight of the PTFE can be reduced by exposing the conductive composite 11 to an irradiation at a dose ranging from 2.5 to 40 Mrad.

The conductive filler 113 dispersed in the conductive composite 11 can be carbon black, nickel powder, titanium carbide, tungsten carbide, or the mixture of the aforementioned materials. The volume ratio of conductive filler to conductive composite ranges from 20% to 50%.

The non-conductive filler 114 similarly disperses in conductive composite 11. The non-conductive filler can be ceramic, for example, magnesium hydroxide or aluminum hydroxide. The volume ratio of the non-conductive filler to the conductive composite 11 ranges from 2% to 15%.

The following are multiple samples of the conductive composite 11 according to the present invention.

Table 1 shows the composition of multiple conductive composite 11 samples.

Table 1 shows the materials composition and experimental result of sample 1 to sample 6, and comparative samples 1 and 2. Two PVDFs were utilized, and had been named as PVDF-1 and PVDF-2, respectively. PVDF-1 has a density of 1.78 g/cm$^3$ and a melting point of 170 degrees Celsius. The PVDF-1 has a high MFR, which ranges from 7 to 35 g/10 min. The PVDF-2 has a low MFR, which ranges from 0.6 to 18 g/10 min. The PTFE powder has a density of 0.961 g/cm$^3$, and a melting temperature of 325 degrees Celsius. The PTFE powder has an average diameter of from 1 to 50 micrometers. The magnesium hydroxide has a purity of approximately 96.9 wt %.

TABLE 1

| | Composition (Vol %) | | | | | Initial Resistance | Trip Endurance 16 V 50 A 48 hr | Cycle Life 16 V/100 A 100 cycles | Activation Time Test 12 V/4.0 A (s) | | |
|---|---|---|---|---|---|---|---|---|---|---|---|
| | PVDF-1 | PVDF-2 | PTFE | CB | $Mg(OH)_2$ | (Ω) | (Ω) | (Ω) | −40° C. | 23° C. | 80° C. |
| Sample 1 | 50 | 8 | 1 | 37 | 4 | 0.29 | 0.49 | 0.21 | 12.5 | 3.73 | 1.39 |
| Sample 2 | 56 | 7 | 1 | 34 | 2 | 0.46 | 0.73 | 0.41 | 10.25 | 3.65 | 1.28 |
| Sample 3 | 31 | 20 | 5 | 38 | 6 | 0.53 | 0.87 | 0.62 | 19.47 | 4.41 | 1.29 |
| Sample 4 | 48 | 0 | 7 | 33 | 12 | 0.29 | 0.523 | 0.26 | 8.37 | 3.14 | 1.39 |
| Sample 5 | 44 | 8 | 10 | 32 | 6 | 0.19 | 0.512 | 0.24 | 13.34 | 4.21 | 1.34 |
| Sample 6 | 42 | 4 | 10 | 36 | 8 | 0.21 | 0.585 | 0.23 | 12.64 | 3.96 | 1.29 |
| Comparative Sample 1 | 58 | 0 | 0 | 36 | 6 | 0.234 | 0.73 | 0.174 | 8.42 | 3.46 | 1.33 |
| Comparative Sample 2 | 56 | 6 | 0 | 34 | 4 | 0.24 | 0.96 | 0.173 | 14.65 | 3.59 | 1.39 |

Manufacturing Process:

Set feed temperature and feed time of the batch mixing machine (Haake-600) are at 200 degrees Celsius and 2 minutes, respectively. According to the composition in Table 1, pre-mixed polymers with determined quantity had been prepared and pre-stirred for several seconds. Next, carbon black (CB) and magnesium hydroxide are added and mixed using a spin speed of 40 rpm. After 3 minutes, the spin speed of the batch mixing machine is raised to 70 rpm and continues mixing for another 7 minutes. After that, mixed material is unloaded and conductive composite with PTC characteristic are obtained.

Next, the precedent conductive composite are placed in a mold, which has an outer layer made of steel plates and a middle portion having a thickness of 1.2 mm, in a vertically symmetrical manner. Two pieces of Teflon demould fabric are placed at the upper and lower parts of the mold, respectively. Pre-press the mold in advance under an operation pressure of 50 kg/cm$^2$ and a temperature of 200 degrees Celsius. The pressing time is 3 minutes, pressing temperature is 200 degrees Celsius, and the pressing pressure is controlled at 100 kg/cm$^2$. Finally, press for 3 minutes under a pressure of 150 kg/cm$^3$ and a temperature of 180 degrees Celsius to form a conductive composite 11, as shown in FIG. 1. According to one embodiment of the present invention, the thickness of the conductive composite 11 is 1.0 mm.

As shown in FIG. 1, due to the low crystalline melting temperatures (lower than 200 degrees Celsius) that PVDF-1 and/or PVDF-2 possess, they tend to melt and become carriers while mixing. PTFE particulates 112 have a crystalline melting temperature higher than 200 degrees Celsius, hence PTFE particulates along with carbon black 113 and magnesium hydroxide particulates 114 are prone to disperse in a particulate manner.

Figure 2:
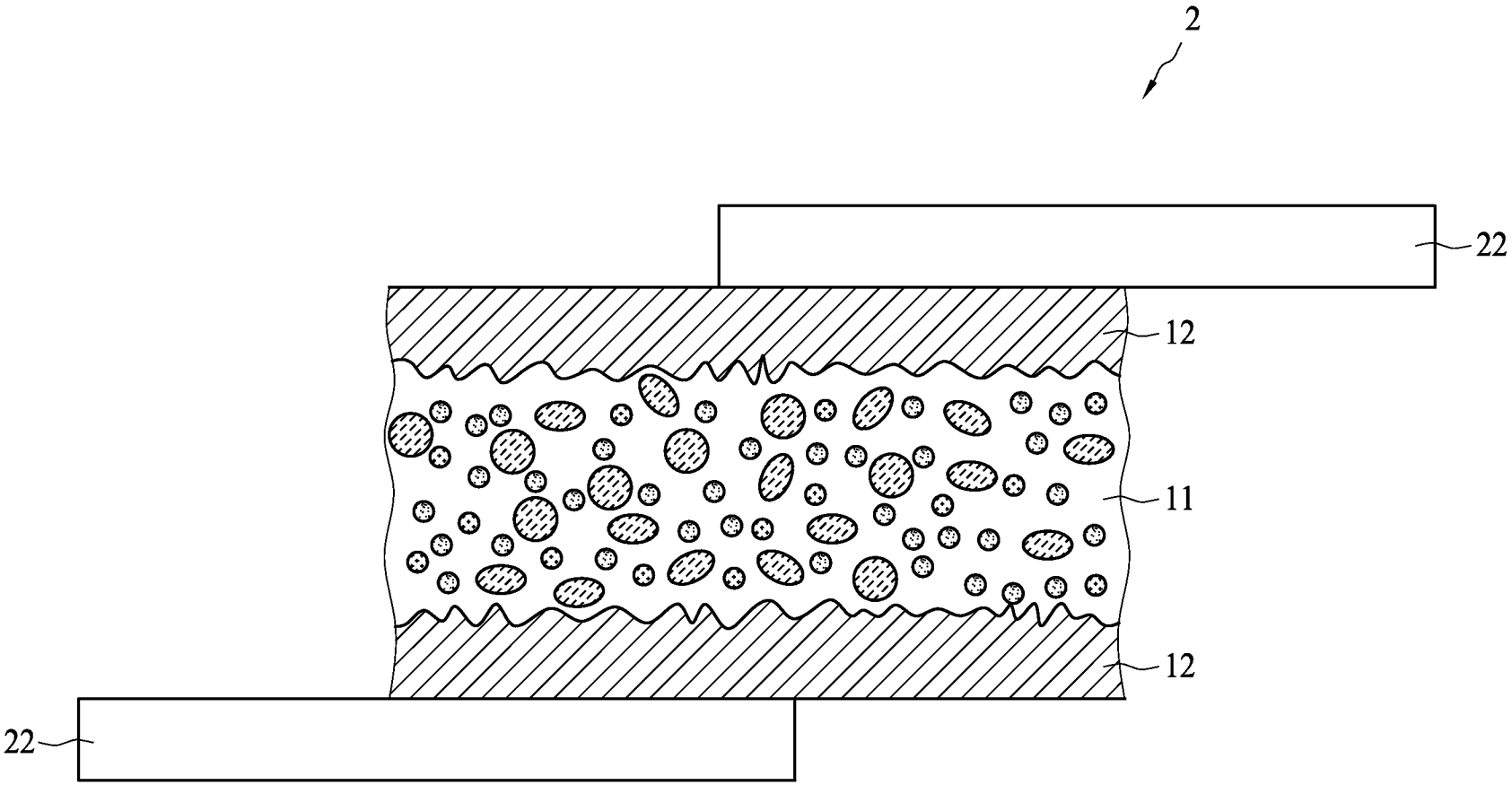
FIG. 2 illustrates an over-current protection device according to one embodiment of the present invention.

Next, the conductive composite 11 is cut into a shape of 20×20 cm$^2$, then two metal foils 12 are pressed to have direct physical contact with the upper and lower surface of the conductive composite 11. More specifically, the surfaces of conductive composite 11 are sequentially covered with metal foils 12 in a vertically symmetrical manner. Metal foils' rough surface containing protruding nodules forms direct physical contact with the conductive composite 11. Next, the conductive composite is pressed for 3 minutes using a buffer material for pressing, Teflon demould fabric, and a steel plate under an operation pressure of 70 kg/cm$^2$ at a temperature of 200 degrees Celsius. Next, the product is cut into an over-current protection chip 1 with a shape of 8 mm×10 mm or 10 mm×12 mm, and irradiated by a Co60 source at a dose ranging from 2.5 to 40 Mrad. Next, solder paste is used to respectively fix two metal electrodes 22 onto two metal foils 12 using a reflowing process to obtain an axial or modular over-current protection device 2, as shown in FIG. 2.

The over-current protection device 1 can, via a printed circuit board process (for detailed manufacturing process please consult U.S. Pat. No. 6,377,467) employed with circuit design, press fit, drilling, etching and surface processing, etc., be fabricated into a surface-mounted over-current protection device; alternatively, the over-current protection device 1 can be processed using electrode pins and surface packaging process to obtain a plug-in over-current protection device.

The over-current protection devices fabricated using the conductive composite 11 in sample 1 to sample 6 can all be tripped. The introduction of PTFE powder not only effectively promotes the stability of the trip resistance change, but also improves recrystallization characteristics of the materials. As shown in sample 1 and comparative sample 1, from the 48-hour trip endurance experimental result, one can find that the conductive composite with 1 vol % PTFE powder (sample 1) has a trip resistance equal to 1.68 times its initial resistance; while the conductive composite without PTFE powder (comparative sample 1) has a trip resistance equal to 3.11 times its initial resistance. Moreover, from the cycle life test after 100 cycles, the resistance of the sample 1 after cycle life test of sample 1 is equal to 0.89 times its initial resistance while the resistance of comparative sample 1 after cycle life test of comparative sample 1 is equal to 0.74 times its initial resistance. This shows that the addition of PTFE powder not only reduces material internal stress, but also decreases the resistance difference of the conductive composite 11 before and after the tripping. Such addition also retains the polymer arrangement after multiple actuations. In addition, as shown in sample 1, after multiple activations, there is a slight rise in crystallinity and a corresponding decrease in resistance. Furthermore, polymer shrinkage may generate some creases on the device's appearance, and more seriously, may cause detachment of the electrode from the conductive composite 11.

Further interpretations can be found by studying sample 2 and comparative sample 2. In the 48-hour trip endurance experimental results, the conductive composite with 1 vol % PTFE powder (sample 2) is shown to have a trip resistance equal to 1.58 times its initial resistance; while the sample in comparative sample 2 has a trip resistance equal to 4 times its initial resistance. Clearly, the conductive composite 11 added with PTFE powder exhibits better resistance recovery. In addition, when comparing the performance between sample 2 and comparative sample 2 in cycle life test, the resistance of sample 2 is equal to 0.89 times its initial resistance while the resistance of comparative sample 2 is equal to 0.72 times its initial resistance. This proves that the addition of PTFE powder substantially boosts the resistance recovery of over-current protection devices.

To modify temperature resistance, by changing the content of PVDF-1 and PVDF-2, one can adjust the activation time of the over-current protection device. Due to less PVDF-1 and more PVDF-2, the activation time of the sample 1 is greater than the activation time of the sample 2. At −40 degrees Celsius, the activation time is 12.5 seconds, which is higher than the 10.25-second activation time as seen in sample 2; at 80 degrees Celsius, the activation time is 1.39 seconds, which is higher than the 1.28 second activation time seen in sample 2. Therefore, changing the content of PVDF-1 and PVDF-2 and adjusting the MFR of conductive composite 11 can increase the device activation temperature, and allow the device to have better humidity and temperature resistance.

Conductive composite 11 further includes a photo-crosslinking compound. The compound facilitates the polymer cross link reaction, thereby increasing the stability of dimension and operating temperature. According to one embodiment, the photo-crosslinking compound includes triallyl isocyanurate (TAIC).

In summary, the over-current protection device comprising the conductive composite, which includes PVDF with specific MFR, PTFE powder with the specific particulate diameter distribution, conductive filler and non-conductive filler can have superior over-current and over-temperature protection capability. Meanwhile the device can still have excellent voltage resistance, resistance recovery, and reliability. Furthermore, by adjusting the MFR of the conductive composite, the device can be configured to be tripped within desired activation time.

Although the present invention and its advantages have been described in detail, it should be understood that various changes, substitutions and alterations can be made herein without departing from the spirit and scope of the invention as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art can readily appreciate from the disclosure of the present invention, processes, machines, manufacture, compositions of matter, means, methods, or steps presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, and/or steps.

What is claimed is:

1. An over-current protection device, comprising:

a conductive composite, comprising:

a first crystalline fluorinated polymer having a crystalline melting temperature of between 150 and 190 degrees Celsius;

a plurality of particulates including a second crystalline fluorinated polymer, disposed in the conductive composite, having a crystalline melting temperature of between 320 and 390 degrees Celsius and having a particulate diameter of from 1 to 50 micrometers;

a conductive filler dispersed in the conductive composite; and a non-conductive filler dispersed in the conductive composite.

2. The over-current protection device of claim 1, wherein the first crystalline fluorinated polymer is polyvinylidene fluoride, and the second crystalline fluorinated polymer is polytetrafluoroethylene.

3. The over-current protection device of claim 2, wherein the conductive composite comprises polyvinylidene fluoride in a volume ratio of between 30% and 65%.

4. The over-current protection device of claim 3, wherein the plurality of particulates are made of ground or smashed polytetrafluoroethylene, or made by emulsion polymerization or suspension polymerization.

5. The over-current protection device of claim 1, wherein the first crystalline fluorinated polymer comprises two polyvinylidene fluorides, wherein the two polyvinylidene fluorides have different melt flow rates.

6. The over-current protection device of claim 5, wherein the melt flow rate of one of the two polyvinylidene fluorides is between 0.6 and 18 g/10 min, whereas the melt flow rate of the other of the two polyvinylidene fluorides is between 7 and 35 g/10 min.

7. The over-current protection device of claim 1, wherein a volume ratio of the plurality of particulates in the conductive composite is between 1% and 15%.

8. The over-current protection device of claim 1, wherein the plurality of particulates have a particulate diameter of between 3 and 25 micrometers.

9. The over-current protection device of claim 1, wherein the plurality of particulates have a crystalline melting temperature of between 321 and 335 degrees Celsius.

10. The over-current protection device of claim 1, wherein the conductive filler is carbon black, nickel powder, titanium carbide, tungsten carbide or a mixture thereof.

11. The over-current protection device of claim 1, wherein the conductive composite comprises the conductive filler with a volume ratio of between 20% and 50%.

12. The over-current protection device of claim 1, wherein the non-conductive filler is magnesium hydroxide or aluminum hydroxide.

13. The over-current protection device of claim 1, wherein the conductive composite comprises the non-conductive filler with a volume ratio of between 2% and 15%.

14. The over-current protection device of claim 1, wherein the conductive composite comprises a photo-crosslinking compound.

15. The over-current protection device of claim 1, wherein the conductive composite undergoes an irradiation process with a dose of between 2.5 and 40 Mrad.

16. The over-current protection device of claim 1, further comprising two metal foils, wherein the conductive composite is positioned between the two metal foils.

17. A method for manufacturing an over-current protection device, comprising the steps of:

mixing, at a predetermined temperature, a first powder of a first crystalline fluorinated polymer, a second power of a second crystalline fluorinated polymer, a conductive filler, and a non-conductive filler to form a conductive mixture, wherein the first powder has a first crystalline melting temperature of between 150 and 190 degrees Celsius, the second powder has a second crystalline melting temperature of between 320 and 390 degrees Celsius, and the predetermined temperature is between the first crystalline melting temperature and the second crystalline melting temperature; and pressing the conductive mixture at the predetermined temperature to obtain a conductive composite.

18. The method for manufacturing an over-current protection device of claim 17, further comprising the steps of:

pressing two metal foils respectively on two opposite surfaces of the conductive composite; and irradiating the conductive composite at a dose of between 2.5 and 40 Mrad.

19. The method for manufacturing an over-current protection device of claim 17, wherein the predetermined temperature is 200 degrees Celsius.

20. The method for manufacturing an over-current protection device of claim 17, wherein the first crystalline fluorinated polymer is polyvinylidene, and the second crystalline fluorinated polymer is polytetrafluoroethylene.

21. The method for manufacturing an over-current protection device of claim 17, wherein a first powder comprises two kinds of polyvinylidene fluoride powder, wherein one kind of polyvinylidene fluoride powder has a melt flow rate of between 0.6 and 18 g/10 min, whereas the other kind of polyvinylidene fluoride powder has a melt flow rate of between 7 and 35 g/10 min.

* * * * *